US008573095B2

(12) United States Patent
Hu

(10) Patent No.: US 8,573,095 B2
(45) **Date of Patent: *Nov. 5, 2013**

(54) OPEN END WRENCH CAPABLE OF FAST DRIVING

(76) Inventor: Bobby Hu, Taichung (TW)

( * ) Notice: Subject to any disclaimer, the term of this patent is extended or adjusted under 35 U.S.C. 154(b) by 203 days.

This patent is subject to a terminal disclaimer.

(21) Appl. No.: 13/196,956

(22) Filed: Aug. 3, 2011

(65) Prior Publication Data

US 2012/0272796 A1 Nov. 1, 2012

(30) Foreign Application Priority Data

Apr. 29, 2011 (TW) ..... 100115291 A

(51) Int. Cl.

| | |
|---|---|
| ***B25B 13/28*** | (2006.01) |
| ***B25B 23/16*** | (2006.01) |
| ***B25B 13/12*** | (2006.01) |
| ***B25B 13/00*** | (2006.01) |

(52) U.S. Cl.

USPC ..... 81/179; 81/177.85; 81/186; 81/92; 81/94

(58) Field of Classification Search

USPC ..... 81/60–63.2, 177.85, 179, 92, 94, 186

See application file for complete search history.

(56) References Cited

U.S. PATENT DOCUMENTS

| | | | | |
|---|---|---|---|---|
| 1,320,668 | A | 11/1919 | Askman | 81/179 |
| 3,695,125 | A | 10/1972 | Glass et al. | 81/179 |
| 4,706,528 | A | 11/1987 | Inoue | 81/179 |
| 7,024,971 | B2 | 4/2006 | Stanton | 81/179 |
| 8,402,866 | B2 * | 3/2013 | Hu | 81/179 |
| 2009/0193941 | A1 | 8/2009 | Chiu et al. | 81/165 |
| 2009/0301271 | A1 | 12/2009 | Tuan-Mu et al. | 81/179 |
| 2010/0071516 | A1 * | 3/2010 | Wu | 81/176.1 |

* cited by examiner

*Primary Examiner* — Monica Carter
*Assistant Examiner* — Danny Hong
(74) *Attorney, Agent, or Firm* — Alan Kamrath; Kamrath IP Lawfirm, P.A.

(57) ABSTRACT

An open end wrench includes first and second jaws. The first jaw includes an arcuate sliding groove having two support walls and an arcuate sliding wall between the support walls. A slide is slideably received in the sliding groove and includes an arcuate sliding face slideable along the sliding wall. Two wings respectively extend from top and bottom faces of the slide. Top and bottom extension faces extend from a wrenching face of the slide and are located on inner faces of the wings. When the open end wrench drives a workpiece to rotate, an outer face of each wing is partially in contact with the second jaw. Force imparted from the workpiece to the wings is transmitted to the second jaw.

13 Claims, 9 Drawing Sheets

OPEN END WRENCH CAPABLE OF FAST DRIVING

BACKGROUND OF THE INVENTION

The present invention relates to an open end wrench capable of fast driving and, more particularly, to an open end wrench capable of fast driving a workpiece without the risk of undesired shifting from the workpiece.

U.S. Pat. No. 1,320,668 discloses a wrench including a stationary jaw and a movable jaw slideable along a guide. The movable jaw is forced against an abutment at an outer end of the guide by a spring bearing against the stationary jaw. An end of the spring is received in a bore in the stationary jaw. The other end of the spring is received in another bore in the movable jaw. An intermediate portion of the spring is exposed between the stationary jaw and the movable jaw. When the user is intended to tighten or loosen a nut, the wrench is turned in a driving direction during which operation the movable jaw remains in contact with the abutment. For reengagement of the wrench with the nut it is necessary only to turn the wrench in the opposite direction, during which operation the movable jaw slides backward against the pressure of the spring and on the edges of the nut. The movable jaw is forced forward again as soon as the bearing surfaces of the stationary and movable jaws are parallel with the sides of the nut. The nut can be tightened or loosened through repeated operations. However, the structural strength of the wrench is insufficient for high-torque operation, as the movable jaw merely encloses the guide and is not enclosed by other members. Furthermore, the guide is irregularly formed in a wrenching space of the wrench, leading to difficulties in processing. Further, the exposed portion of the spring, when compressed by the movable jaw, is liable to bend and, thus, in frictional contact with the end edges of the bores of the stationary and movable jaws, leading to non-smooth compression of the spring or even permanent deformation of the spring. Further, the exposed portion of the spring is apt to be contaminated by oil to which debris easily adheres.

U.S. Pat. No. 3,695,125 discloses an open end ratchet wrench including a head having a fixed jaw and an opposed pawl support portion. A pawl and a spring are mounted to an inner side of the pawl support portion. The pawl is biased by the spring and slideable between an extended torquing position and a retracted ratcheting position. Two side caps are fixed to two sides of the head to define a space receiving the pawl and the spring and to prevent disengagement of the pawl and the spring. The pawl includes a stop shoulder to prevent the pawl from moving out of the pawl support portion under the action of the spring. The pawl support portion includes an arcuate section and then extends perpendicularly to the fixed jaw. Such a structure is difficult to process. Furthermore, assembly of the open end ratchet wrench is troublesome. Further, the pawl is merely enclosed at both sides and has insufficient structural strength in the lateral direction. Further, a contact area of the workpiece (such as a nut) engaged with the movable pawl is smaller than a contact area of the workpiece engaged with the fixed jaw. When the nut is tightened to a position adjacent to an object to be fixed, wear or damage to the nut may occur if the nut has insufficient contact area or has a small volume.

U.S. Pat. No. 4,706,528 discloses an adjustable wrench including a fixed jaw and an adjustable jaw. In an embodiment, a sliding jaw is provided on the fixed jaw. The sliding jaw includes a rectilinearly extending slot through which a pin is extended, preventing disengagement of the sliding jaw. A plate spring is mounted to an inner face of the fixed jaw to bias the sliding jaw outward. A hole is formed in an end wall of the slot and receives a coil spring to bias the sliding jaw inward. Thus, the sliding jaw is movable inward or outward and can be retained in place under action of the plate spring and the coil spring. Such a wrench is particularly suitable for rotating pipes, but not suitable for tightening or loosening fasteners such as bolts, nuts, or the like. This is because the sliding jaw can only slide rectilinearly, and the shape of the slot will cause the sliding jaw to slide along the slot to a position pressing against the periphery of the pipe.

U.S. Pat. No. 7,024,971 discloses an open end ratchet wrench including first and second stationary jaws. The first stationary jaw supports a movable plate. A space is sandwiched between two face plates of the first stationary jaw to accommodate the movable plate. The movable plate includes two angled slots each receiving a pin extending through the space, avoiding disengagement of the movable plate. The wrench further includes a hole receiving a spring that has an end located outside of the hole for biasing the movable plate. Each angled slot of the movable plate includes a short section and a long section at an angle to the short section such that the movable plate can move in two stages each having a rectilinear travel. However, the stationary jaw is enclosed by the movable plate such that the contact area between the stationary jaw and the workpiece is significantly decreased. Instead, the supporting effect depends on the larger contact area between the workpiece and the movable plate with structural strength weaker than the fixed jaw. The holding force applied by the open end ratchet wrench is reduced.

U.S. Publication No. 2009/0193941 A1 discloses first and second jaws formed on a jaw support. The first jaw can be moved by rotating a worm. The jaw support includes an open track in the form of a slot receiving the second jaw. The jaw support further includes a pin extending through the track. The second jaw includes a rectilinear opening through which the pin extends, preventing the second jaw from disengaging from the jaw support. A biasing member is mounted in the opening of the second jaw to bias the second jaw outward. Since the second jaw includes a single rectilinear opening, a change in the spacing from the second jaw to the first jaw is relatively small such that a workpiece will be rotated when the wrench rotates in a reverse direction not intended to rotate the workpiece. Thus, the first jaw must be movable, and the spacing between the first and second jaws can be adjusted by rotating the worm to avoid joint rotation of the workpiece when the wrench rotates in the reverse direction. However, the wrench of this type includes many elements, and the track, opening, and holes in the elements weaken the wrench. Furthermore, since the track is open, the reactive force imparted to the second jaw during driving of the workpiece is completely transmitted to the pin. Thus, the pin is liable to be damaged. Although the second jaw includes a surface in sliding contact with the jaw support to guide sliding movement of the second jaw, this surface merely transmits the reactive force to the pin instead of effectively withstanding the torque. Further, since the second jaw moves rectilinearly, the opening in the second jaw must be lengthened if it is desired to increase the spacing between the first and second jaws. However, this would expose the opening support such that the opening and the biasing member in the opening would easily be contaminated by oil to which debris adheres easily. Furthermore, operation of the biasing member would be adversely affected, causing non-smooth movement of the second jaw.

U.S. Patent Publication No. US 2009/0301271 A1 discloses an open-ended wrench including a first jaw and a second jaw. The second jaw includes an auxiliary jaw retracting opening that receives an auxiliary jaw. A spring is mounted between an end of the auxiliary jaw and an end wall of the auxiliary jaw retracting opening. The auxiliary jaw includes a limiting slot. An auxiliary jaw limiting member extends from a surface of the second jaw through an opening to the auxiliary jaw retracting opening and is coupled with the limiting slot for confining the auxiliary jaw to move between a first position in which the auxiliary jaw is non-longitudinally biased and a second position in which the auxiliary jaw is longitudinally biased. The auxiliary jaw has an arcuate pushing surface and a driving surface. In use, the wrench can drive a nut in a driving direction to a position and then directly move in a reverse direction about the center of the nut. The auxiliary jaw is compressed by a side of the nut and retracts into the auxiliary retracting opening. Thus, the wrench can be directly rotated in the reverse direction through an angle to a next driving position for driving the nut in the driving direction without the need of disengaging from the nut and reengaging with the nut. However, it is difficult to form the auxiliary jaw retracting opening in the second jaw, which is particularly true for axial drilling. Furthermore, the pushing face and the driving surface of the auxiliary jaw must retract into the auxiliary retracting opening so that the wrench can move in the reverse direction to the next driving position. Thus, the widths of the pushing face and the driving surface must be smaller than the size of the auxiliary jaw retracting opening. However, if the nut is of a smaller thickness or if the nut is moved to a position adjacent to a surface of an object to be tightened such that the width of the side of the nut is smaller than the extent of the pushing face and the driving surface, the pushing face and the driving surface may be worn or damaged due to insufficient contact area with the side of the nut.

U.S. Patent Publication No. US 2010/0071516 A1 discloses a reciprocatable open end wrench including first and second jaws and a swing member. The second jaw includes a concave arcuate surface having a slot. The swing member is received in the slot. A surface of the swing member faces the second jaw and has an arcuate hollow groove for receiving a returning device. A retaining pin is inserted into the hollow groove in a manner that allowing the swing member to be slideable relative to the second jaw. The returning device presses against the retaining pin and the swing member and, thus, biases the swing member outward. However, the diameter of the curvature of the concave arcuate face is not concentric to a wrenching width between two parallel sides of a workpiece. After the wrench has driven the workpiece to rotate in a driving direction, the rotating arc of the diameter can not allow the wrench to rotate in a reverse direction to the next driving position. Specifically, the wrench has to be moved backwards through a certain travel so that the concave arcuate face can slide along the side of the workpiece to the next driving position. If the wrench is directly rotated about the center of the workpiece without the backward travel, the arcuate face will be interfered by a side of the workpiece. The driving operation provided by the wrench is not smooth.

Thus, a need exists for an open end wrench capable of fast driving of a workpiece without the disadvantages of the above conventional open end wrenches.

BRIEF SUMMARY OF THE INVENTION

The present invention solves this need and other problems in the field of reliable structural strength of fast drivable open end wrenches by providing an open end wrench capable of fast driving a workpiece. The workpiece includes an outer periphery having first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction. The open end wrench includes a body having a handle and a jaw portion formed on an end of the handle. Spaced first and second jaws are formed on an end of the jaw portion opposite to the handle. The first and second jaws and the jaw portion are integrally formed as a single and inseparable component of a same material. The jaw portion further includes a throat intermediate the first and second jaws. The first jaw includes a front end and a rear end. The rear end of the first jaw is connected to the throat. The second jaw includes a front end and a rear end. The rear end of the second jaw is connected to the throat. The throat and the first and second jaws together define a wrenching space. The wrenching space is adapted to receive the workpiece. The first jaw includes a force-applying face facing the wrenching space. The jaw portion further includes an arcuate sliding groove facing the wrenching space. The sliding groove includes spaced, first and second support walls and an arcuate sliding wall extending between the first and second support walls. A guide is fixed in the sliding groove and includes two ends fixed in the first and second support walls. A slide is slideably received in the sliding groove. The slide includes a first side having an arcuate sliding face slideable along the sliding wall of the sliding groove. The slide is capable of driving the workpiece or sliding along the outer periphery of the workpiece. The slide is movable between an extended position and a retracted position. The slide further includes a second side opposite to the first side of the slide. The second side of the slide is located outside of the sliding groove and includes a first wrenching face located in a front end of the slide. The slide further includes a top face and a bottom face. The top face slideably abuts the first support wall. The bottom face slideably abuts the second support wall. The top and bottom faces are symmetrically supported by the first and second support walls. The slide further includes an arcuate guiding slot extending from the top face through the bottom face. The guide is received in the guiding slot, preventing the slide from disengaging from the sliding groove. The guiding slot includes an abutting end and a pressing end. The front end of the slide includes two wings respectively extending away from the top and bottom faces. Each wing includes inner and outer faces. The inner faces of the wings are adapted to drive the workpiece. An elastic element is mounted in the guiding slot and has two ends respectively abutting the guide and the pressing end of the guiding slot. The elastic element urges the abutting end of the guiding slot to contact with the guide, biasing the slide to the extended position.

When the open end wrench drives the workpiece to rotate in a first direction, the slide is in the extended position, and the outer face of each wing is partially in contact with the second jaw. Force imparted from the workpiece to the two wings is transmitted to the second jaw, and the slide stably abuts the workpiece.

When the open end wrench rotates in a second direction reverse to the first direction, the slide moves towards the retracted position, and a contact area between the outer face of each wing is gradually increased. When the open end wrench reaches a next driving position for driving the workpiece to rotate in the first direction, the elastic element moves the slide to the extended position, and the contact area between the outer face of each wing is gradually decreased.

Preferably, with the first wrenching face includes a top extension face extending away from the top face and a bottom extension face extending away from the bottom face. The top and bottom extension faces are coplanar to the first wrenching face and located on the inner faces of the wings. Only a portion of the outer face of each wing contacts with the first face of the second jaw when the workpiece is driven by the open end wrench in the first direction. The outer face of each wing has a curvature equal to that of the first face of the second jaw, providing surface contact between the portion of the outer face of each wing and the first face of the second jaw.

Preferably, the sliding wall of the sliding groove is free of holes, grooves, and recesses and has a concave, arcuate face. The sliding face of the slide is free of holes, grooves, and recesses and has a convex, arcuate face. The guiding slot is free of holes, grooves, and recesses.

Preferably, the force-applying face faces the front end of the second jaw. The sliding groove is formed in the second jaw and the throat and faces the wrenching space. The force-applying face is adapted to correspond to the first force-receiving face in the first rotating direction of the workpiece. The first wrenching face and the wings of the slide are adapted to correspond to the fourth force-receiving face in the first rotating direction of the workpiece when the slide is in the extended position.

Preferably, with the sliding face of the slide has a first curvature. The sliding wall of the sliding groove has a second curvature equal to the first curvature. The sliding face of the slide is smoothly slideable along the sliding wall of the sliding groove. The sliding face is adapted to transmit reactive force from the workpiece to the sliding wall and to avoid concentration of stress on the slide, increasing torque bearing capacity of the slide when the workpiece is driven by the body to rotate. The guiding slot has a third curvature equal to the second curvature, allowing relative smooth, arcuate sliding between the guiding groove of the slide and the guide in the sliding groove without operational interference therebetween.

Preferably, the slide further includes a second wrenching face at an angle of 120° to and located behind the first wrenching face. The second wrenching face is adapted to correspond to the third force-receiving face in the first rotating direction of the workpiece. The slide further includes an evasive portion between the first and second wrenching faces. The evasive portion of the slide is adapted to allow entrance of the third force-receiving face in the second rotating direction of the workpiece.

Preferably, the throat includes a push face facing the wrenching space. The push face is at an angle of 120° to the force-applying face of the first jaw. The push face of the throat is adapted to correspond to the second force-receiving face in the first rotating direction of the workpiece.

Preferably, the second jaw includes first and second faces. The first face of the second jaw faces the wrenching space and the rear end of the first jaw. The second face of the second jaw faces the wrenching space and the front end of the first jaw. The first face of the second jaw is at an angle of 120° to the second face of the second jaw. The first and second faces of the second jaw are adapted to correspond respectively to the fourth and third force-receiving faces in the first rotating direction of the workpiece. The first face of the second jaw is parallel to the force-applying face of the first jaw. A first evasive portion is formed between the force-applying face of the first jaw and the push face of the throat. The first evasive portion is adapted to allow entrance of the first force-receiving face in the second rotating direction of the workpiece. A second evasive portion is formed between the push face of the throat and the second face of the second jaw. The second evasive portion is adapted to allow entrance of the second force-receiving face in the second rotating direction of the workpiece. The jaw portion further includes a third evasive portion between first and second faces of the second jaw. The third evasive portion is adapted to allow entrance of the third force-receiving face in the second rotating direction of workpiece.

Preferably, the first and second support walls of the sliding groove are parallel to each other and have a spacing therebetween. The top and bottom faces of the slide are parallel to each other and have a height in a height direction of the slide equal to the spacing. The guiding slot of the slide has a height in the height direction of the slide equal to the height of the slide. The guiding slot has a width in a width direction perpendicular to the height direction of the guiding slot. The width of the guiding slot is equal to a diameter of the guide. The height of the guiding slot is larger than 1.5 times the width of the guiding slot. The elastic element has a height in the height direction of the slide not larger than the height of the guiding slot. The height of the elastic element is larger than the width of the guiding slot and larger than 0.5 times the height of the guiding slot.

When the jaw portion does not receive the workpiece, the abutting end of the guiding slot is in contact with the guide. The slide is in the extended position. The first wrenching face of the slide and the top and bottom extension faces extend into the wrenching space. The first wrenching face of the slide is not parallel to the force-applying face of the first jaw.

When the jaw portion receives the workpiece but does not drive workpiece, the force-applying face of the first jaw abuts the first force-receiving face in the first rotating direction of the workpiece. The front end of slide abuts the fourth force-receiving face in the first rotating direction of the workpiece. A gap exists between the abutting end of the guiding slot and the guide. The gap is larger than a tolerance of the workpiece.

When the workpiece is rotated by the jaw portion and causes deformation of the jaw portion, the body slightly rotates relative to the workpiece. The gap prevents the slide from rotating together with the body. The front end of the slide remains abutting the fourth force-receiving face in the first rotating direction of the workpiece while the jaw portion expands elastically.

When the jaw portion receives the workpiece but does not drive the workpiece. A buffering angle is formed between the first wrenching face of slide and the fourth force-receiving face in the first rotating direction of the workpiece. The buffering angle allows the body and the slide to gradually rotate relative to the workpiece when the jaw portion expands elastically. The first wrenching face of the slide abuts the fourth force-receiving face in the first rotating direction of the workpiece, providing surface contact between the first wrenching face of the slide and the fourth force-receiving face in the first rotating direction of the workpiece. The buffering angle is larger than 2°.

Preferably, the first wrenching face of the slide includes at least one groove to increase friction between the first wrenching facer and the fourth force-receiving face in the first rotating direction of the workpiece.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
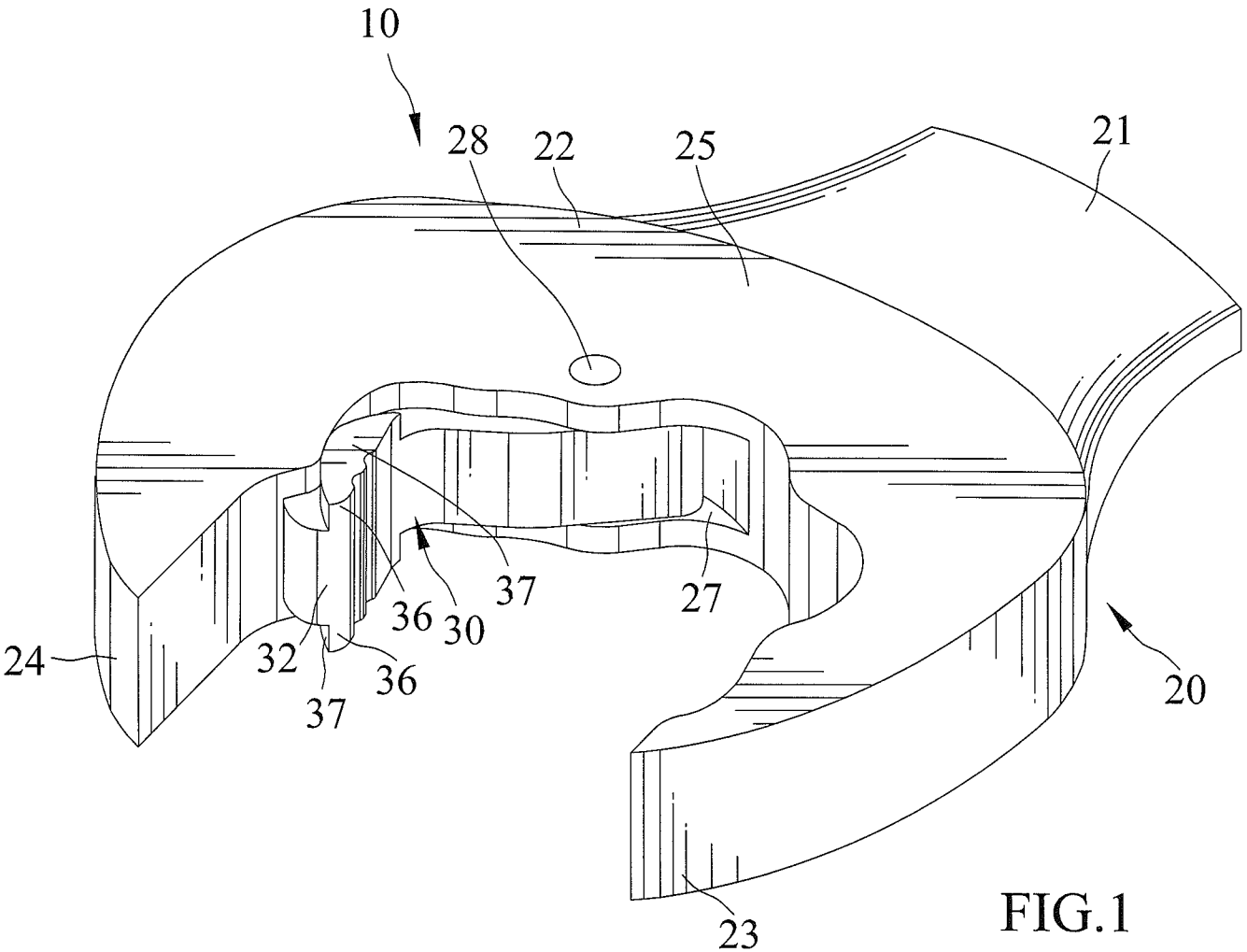
FIG. 1 shows a partial, perspective view of an open end wrench according to the present invention.
Figure 2:
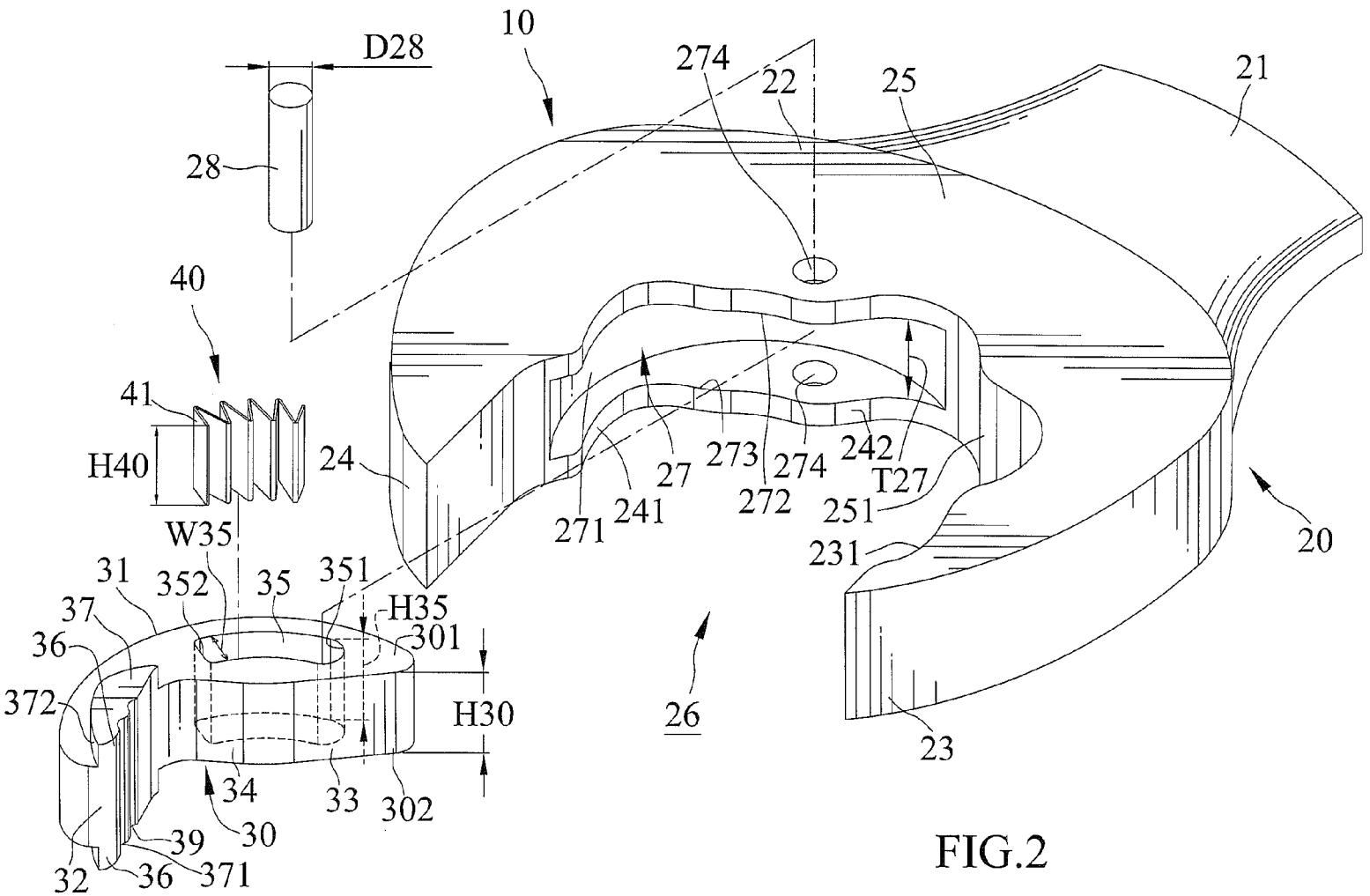
FIG. 2 shows a partial, exploded, perspective view of the open end wrench of FIG. 1.

All figures are drawn for ease of explanation of the basic teachings of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "fifth", "sixth", "lower", "upper", "inner", "outer", "side", "end", "portion", "section", "spacing", "clockwise", "counterclockwise", "width", "height", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An open end wrench 10 according to the present invention is shown in FIGS. 1-9. In the form shown, open end wrench 10 includes a body 20, a slide 30, and an elastic device 40. Body 20 includes a handle 21 and a jaw portion 22 formed on an end of handle 21. Jaw portion 22 can hold a workpiece 90, such as a hexagonal head of a bolt, a nut, or the like. Workpiece 90 includes an outer periphery having first, second, third, fourth, fifth, and sixth sides 91, 92, 93, 94, 95, and 96 respectively having first, second, third, fourth, fifth, and sixth force-receiving faces in a first rotating direction 91A, 92A, 93A, 94A, 95A, and 96A. First, second, third, fourth, fifth, and sixth sides 91, 92, 93, 94, 95, and 96 of workpiece 90 respectively have first, second, third, fourth, fifth, and sixth force-receiving faces in a second rotating direction 91B, 92B, 93B, 94B, 95B, and 96B. A user can grip the handle 21 and rotate body 20 as well as jaw portion 22 about an axis of workpiece 90 to tighten or loosen workpiece 90.

Spaced first and second jaws 23 and 24 are formed on an end of jaw portion 22 opposite to handle 21. First and second jaws 23 and 24 can withstand reactive force from workpiece 90. First and second jaws 23 and 24 face each other. Furthermore, first and second jaws 23 and 24 and jaw portion 22 are integrally formed as a single and inseparable component of the same material to provide jaw portion 22 with excellent structural strength and to increase the torque bearing capacity of jaw portion 22.

Jaw portion 22 further includes a throat 25 intermediate first and second jaws 23 and 24. Throat 25 and first and second jaws 23 and 24 together define a wrenching space 26. Workpiece 90 can enter wrenching space 26 by moving jaw portion 22 in a direction perpendicular to one of the six sides of workpiece 90 or by moving jaw portion 22 along the axis of workpiece 90.

First jaw 23 includes a front end and a rear end connected to throat 25. Second jaw 24 includes a front end and a rear end connected to throat 25.

First jaw 23 includes a force-applying face 231 facing wrenching space 26 and facing the front end of second jaw 24. Force-applying face 231 corresponds to first force-receiving face in the first rotating direction 91A of workpiece 90. Second jaw 24 includes first and second faces 241 and 242. First face 241 faces wrenching space 26 and the rear end of first jaw 23. Second face 242 faces wrenching space 26 and the front end of first jaw 23. First and second faces 241 and 242 correspond respectively to fourth and third force-receiving faces in the first rotating direction 94A and 93A. First face 241 of second jaw 24 is substantially parallel to force-applying face 231 of first jaw 23.

Throat 25 includes a push face 251 facing wrenching space 26. Push face 251 is at an angle of 120° to force-applying face 231 of first jaw 23 such that push face 251 corresponds to second force-receiving face in the first rotating direction 92A. Second face 242 is intermediate first face 241 and push face 251.

Jaw portion 22 further includes a first evasive portion 221 between force-applying face 231 of first jaw 23 and push face 251 of throat 25. First evasive portion 221 can receive first force-receiving face in the second rotating direction 91B of workpiece 90. Jaw portion 22 further includes a second evasive portion 222 between push face 251 of throat 25 and second face 242 of second jaw 24. Second evasive portion 222 can receive second force-receiving face in the second rotating direction 92B of workpiece 90. Furthermore, jaw portion 22 includes a third evasive portion 223 between first and second faces 241 and 242 of the second jaw 24. Third evasive portion 223 can receive third force-receiving face in the second rotating direction 93B of workpiece 90.

An arcuate sliding groove 27 is formed in second jaw 24 and throat 25 and faces wrenching space 26. Sliding groove 27 includes spaced, first and second support walls 272 and 273 and a concave, arcuate sliding wall 271 extending between first and second support walls 272 and 273. Sliding wall 271 is free of holes, grooves, recesses, etc, providing a complete concave arcuate surface and enhancing the structural strength of second jaw 24. Thus, jaw portion 22 can withstand high-torque operation. Furthermore, a center of a concave, arcuate face of the sliding wall 271 is located in wrenching space 26 such that sliding wall 271 can be easily and rapidly processed with a single cutter at low costs while assuring structural strength of jaw portion 22. First and second support walls 272 and 273 are parallel to each other and have a spacing T27 therebetween.

A circular through-hole 274 is extended through first and second support walls 272 and 273 and in communication with sliding groove 27. Through-hole 274 is located adjacent to throat 25 and receives a cylindrical guide 28 in the form of a pin. Two ends of guide 28 are received in two ends of through-hole 274 in first and second support walls 272 and 273 to retain guide 28 in sliding groove 27. Guide 28 has a diameter D28.

Slide 30 is slideably received in sliding groove 27 between an extended position and a retracted position and can drive workpiece 90 to rotate in a driving direction or slide along a perimeter of workpiece 90 in a reverse direction opposite to the driving direction without driving workpiece 90. Slide 30 is substantially arcuate in cross section and includes a side having a convex, arcuate sliding face 31 slideably abutting sliding wall 271 of sliding groove 27, allowing relative arcuate sliding movement between slide 30 and jaw portion 22. Sliding face 31 is free of holes, grooves, recesses, etc, providing a complete convex, arcuate surface and enhancing the structural strength of slide 30. Thus, slide 30 can withstand high-torque operation.

Sliding face 31 of slide 30 has a curvature the same as that of sliding wall 271 of sliding groove 27 to allow smooth sliding of sliding face 31 on sliding wall 271. Furthermore, when slide 30 is subjected to reactive force from workpiece 90, due to the same curvature of sliding wall 271 and sliding face 31, the reactive force from the workpiece 90 can be transmitted to sliding wall 271 through a large area of sliding face 31 while avoiding wobbling of sliding 30 during rotation of workpiece 90. Thus, the torque bearing capacity of slide 30 is increased when workpiece 90 is driven by body 20.

The other side of slide 30 opposite to sliding face 31 is located outside of sliding groove 27 and includes first and second wrenching faces 32 and 33. First and second wrenching faces 32 and 33 are adapted to drive workpiece 90 to rotate. First wrenching face 32 is at an angle of 120° to second wrenching face 33. First wrenching face 32 is located on a front end of slide 30, and second wrenching face 33 is located in a rear end of slide 30. When slide 30 is in the extended position, first and second wrenching faces 32 and 33 correspond respectively to fourth and third force-receiving faces in the first rotating direction 94A and 93A of workpiece 90. An evasive portion 34 is formed between first and second wrenching faces 32 and 33 and can receive third force-receiving face in the second rotating direction 93B of workpiece 90.

Slide 30 further includes a top face 301 and a bottom face 302 respectively at upper and lower sides thereof. First and second wrenching faces 32 and 33 extend between top and bottom faces 301 and 302. Top and bottom faces 301 and 302 are parallel to each other and slideably abut with first and second support walls 272 and 273 of sliding groove 27, respectively. Slide 30 has a height H30 between top and bottom faces 301 and 302 in a height direction. Ignoring the tolerance, height H30 of slide 30 is the same as spacing T27 of sliding groove 27. This allows top and bottom faces 301 and 302 of slide 30 to be symmetrically supported by first and second support walls 272 and 273 of sliding groove 27, avoiding wobbling of slide 30 while sliding in sliding groove 27 along an arcuate path and increasing operational stability of open end wrench 10.

Slide 30 further includes a guiding slot 35 extending from top face 301 through bottom face 302. Guiding slot 35 is arcuate in cross section and has a curvature the same as the curvature of sliding wall 271 of sliding groove 27. Since guiding slot 35 extends from top face 301 through bottom face 302, a height H35 of guiding slot 35 in the height direction of slide 30 is the same as height H30 of slide 30. Furthermore, guiding slot 35 has a width W35 (between inner and outer arcuate surfaces thereof) in a width direction perpendicular to the height direction of slide 30. Namely, width W35 is equal to a difference between a radius of the outer arcuate surface and a radius of the inner arcuate surface of guiding slot 35. Ignoring the tolerance, width W35 of guiding slot 35 is the same as diameter D28 of guide 28. Height H35 of guiding slot 35 is larger than 1.5 times width W35 of guiding slot 35 (i.e., width W35 of guiding slot 35 is smaller than 0.66 times height H35 of guiding slot 35). In this embodiment, height H35 of guiding slot 35 is larger than two times width W35 of guiding slot 35 (i.e., width W35 of guiding slot 35 is smaller than 0.5 times height H35 of guiding slot 35).

Guiding slot 35 receives guide 28 to prevent slide 30 from disengaging from sliding groove 27. Since the curvature of sliding face 31 of slide 30 is the same as those of guiding slot 35 and sliding wall 271 of sliding groove 27, smooth sliding movement between guiding slot 35 of slide 30 and guide 28 in sliding groove 27 can be obtained while sliding face 31 of slide 30 is moving along sliding wall 271 of sliding groove 27 along the arcuate path. Undesired interference between slide 30, guide 28, and sliding wall 271 is avoided.

Guiding slot 35 further includes an abutting end 351 and a pressing end 352. When slide 30 is in the extended position, abutting end 351 is in contact with guide 28, and pressing end 352 is in contact with elastic device 40. Since all of the surfaces of guiding slot 35 are free of holes, grooves, recesses, etc, stress concentration is avoided, and the structural strength of slide 30 is assured. Thus, slide 30 can withstand high-torque operation. Furthermore, since sliding face 31 and all of the surfaces of guiding slot 35 of slide 30 are free of holes, grooves, recesses, etc, the manufacturing costs of slide 30 can be reduced while providing open end wrench 10 with high-torque capacity and allowing open end wrench 10 to be produced at low costs for wider industrial application.

Elastic device 40 has two ends respectively abutting guide 28 and pressing end 352 of guiding slot 35 for returning slide 30 to the extended position. Elastic device 40 includes an elastic element 41. After mounting, elastic element 41 is completely received in guiding slot 35. Elastic element 41 has a height H40 in the height direction of slide 30. In this embodiment, height H40 of elastic element 41 is not larger than height H35 of guiding slot 35 and larger than width W35 of guiding slot 35. Furthermore, height H40 of elastic element 41 is larger than 0.5 times height 1135 of guiding slot 35. By providing such an elastic element 41, elastic element 41 will not move away from its initial position in guiding slot 35, reliably returning slide 30 to the extended position under the bias of elastic element 41. In this embodiment, elastic element 41 is a resilient plate having a plurality of interconnected Z-shaped sections.

First wrenching face 32 includes a top extension face 36 extending away from top face 301 and a bottom extension face 36 extending away from bottom face 302. Top and bottom extension faces 36 are coplanar to first wrenching face 32. The front end of slide 30 includes two wings 37 respectively extending away from top and bottom faces 301 and 302. Each wing 37 includes an inner face 371 and an outer face 372. Top extension face 36 is located on inner face 371 of one of wings 37, and bottom extension face 36 is located on inner face 371 of the other wing 37. When slide 30 is in the extended position, first wrenching face 32 corresponds to fourth force-receiving face in the first rotating direction 94A of workpiece 90. Wings 37 of slide 30 can wrench fourth force-receiving face in the first rotating direction 94A of workpiece 90.

Figure 5:
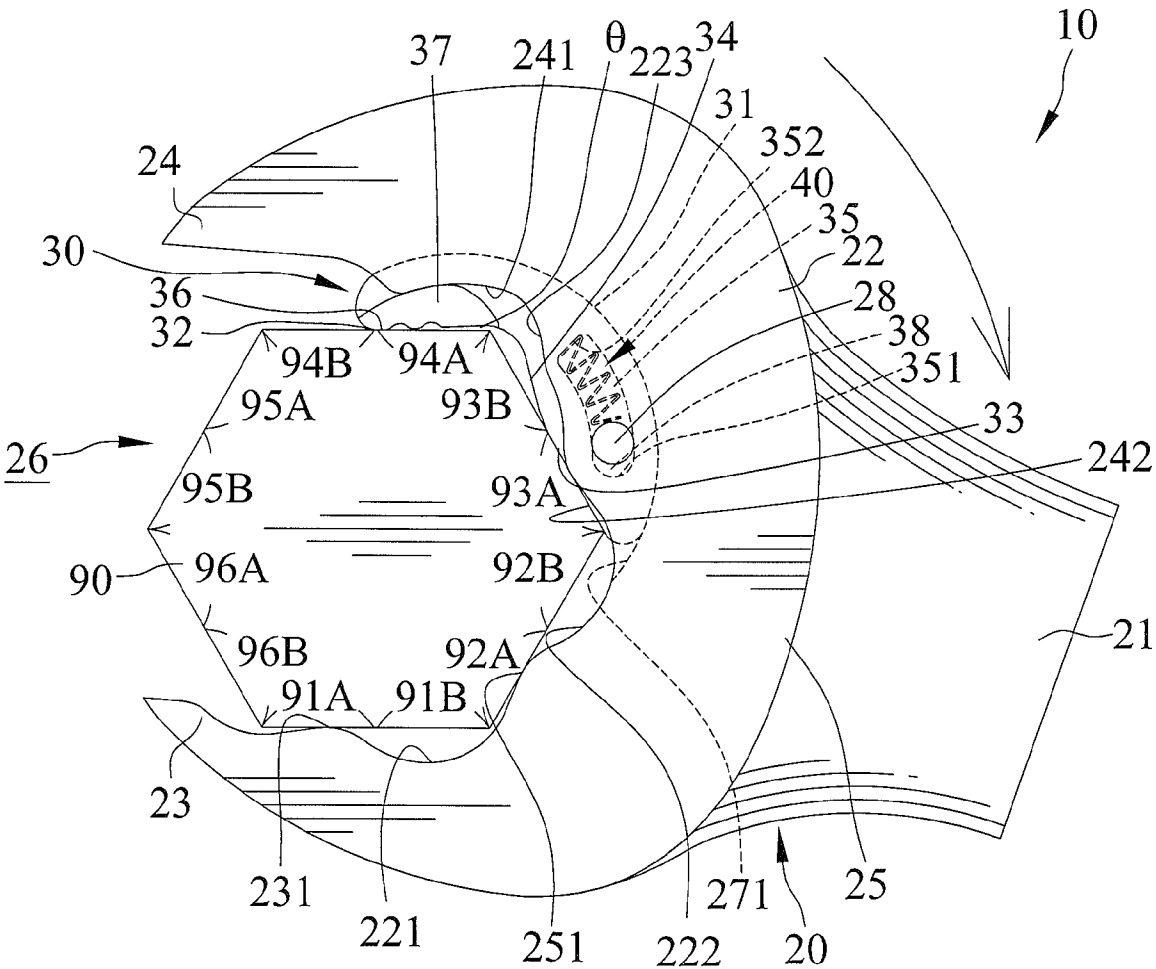
FIG. 5 shows a partial, top view of the open end wrench of FIG. 1 and a workpiece, illustrating rotation of the open end wrench in a driving direction driving the workpiece.

FIG. 5 shows rotation of open end wrench 10 according to the preferred teachings of the present invention in the driving direction towards first jaw 23 (the clockwise direction in FIG. 5) to drive workpiece 90. Slide 30 is in the extended position. A portion of outer face 372 of each wing 37 is in contact with second jaw 24, such that the force imparted from workpiece 90 to wings 37 can be transmitted to second jaw 24, increasing the torque for rotating workpiece 90 by open end wrench 10 and providing high-torque driving effect. Furthermore, slide 30 stably abuts fourth force-receiving face in the first rotating direction 94A of workpiece 90.

In the form shown, the curvature of outer face 372 of each wing 37 is the same as that of first face 241, such that a portion of outer face 372 of each wing 37 is in surface contact with first face 241 of second jaw 24, as shown in FIG. 5. High-torque driving effect is, thus, provided.

Figure 6:
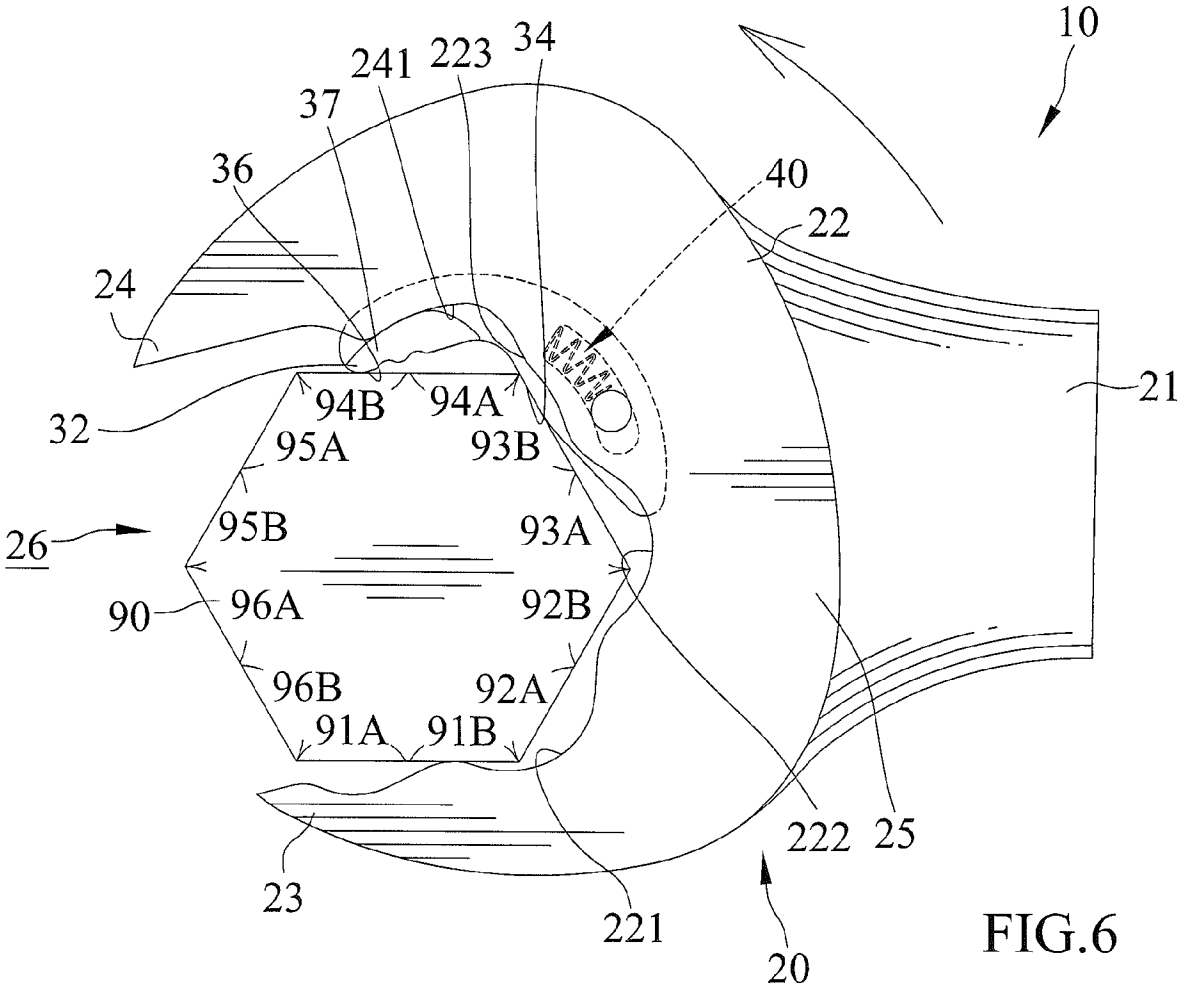
FIG. 6 shows a cross sectional view illustrating rotation of the open end wrench of FIG. 5 in a non-driving direction reverse to the driving direction without driving the workpiece.
Figure 7:
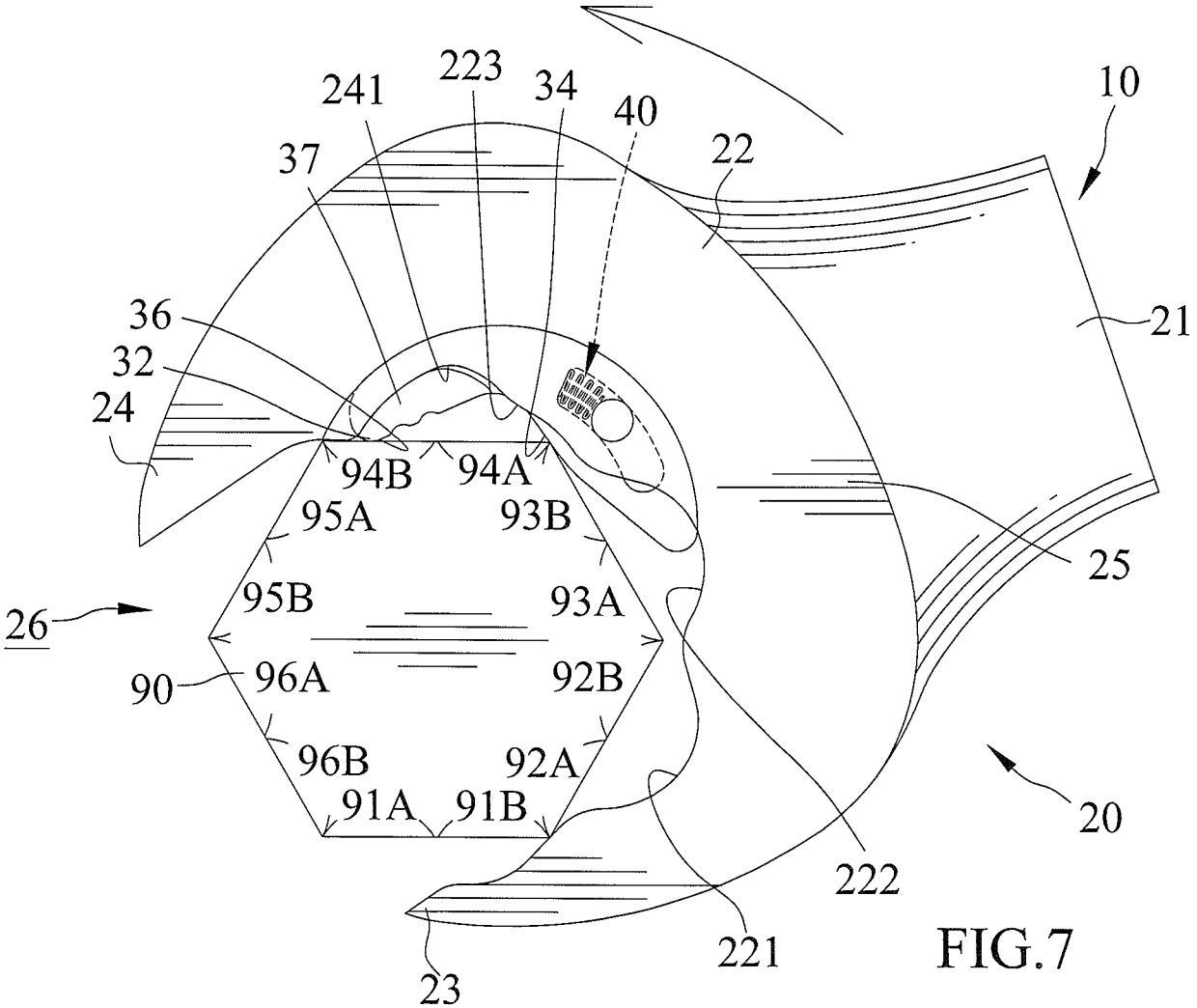
FIG. 7 shows a cross sectional view illustrating further rotation of the open end wrench of FIG. 6 in the non-driving direction.
Figure 8:
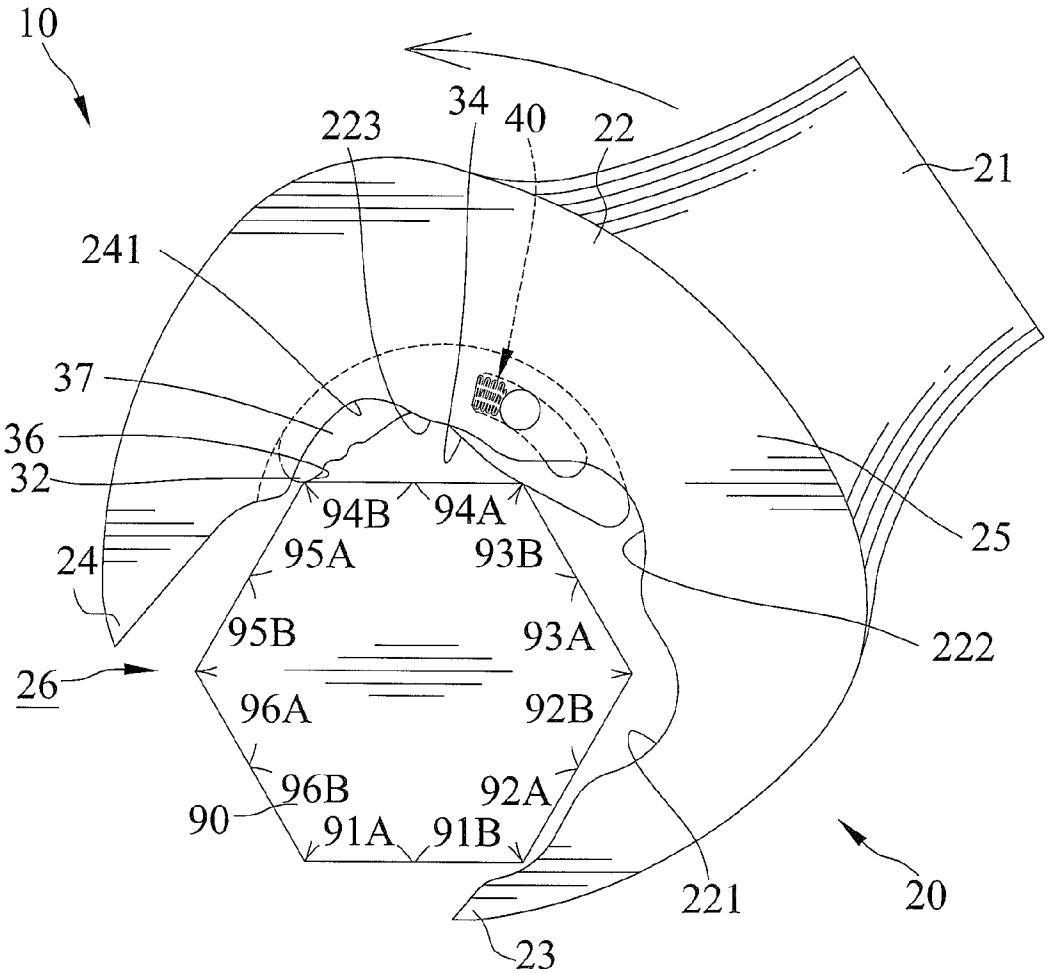
FIG. 8 shows a cross sectional view illustrating further rotation of the open end wrench of FIG. 7 in the non-driving direction.

With reference to FIGS. 6-8, since not all of outer face 372 of each wing 37 is in contact with second jaw 24, the contact area between outer face 372 of each wing 37 and second jaw 24 is gradually increased when open end wrench 10 moves in the reverse direction and causes movement of slide 30 to the retracted position away from abutting end 351 of guiding slot 35, avoiding damage to elastic device 40 while open end wrench 10 moves rapidly in the reverse direction.

Figure 9:
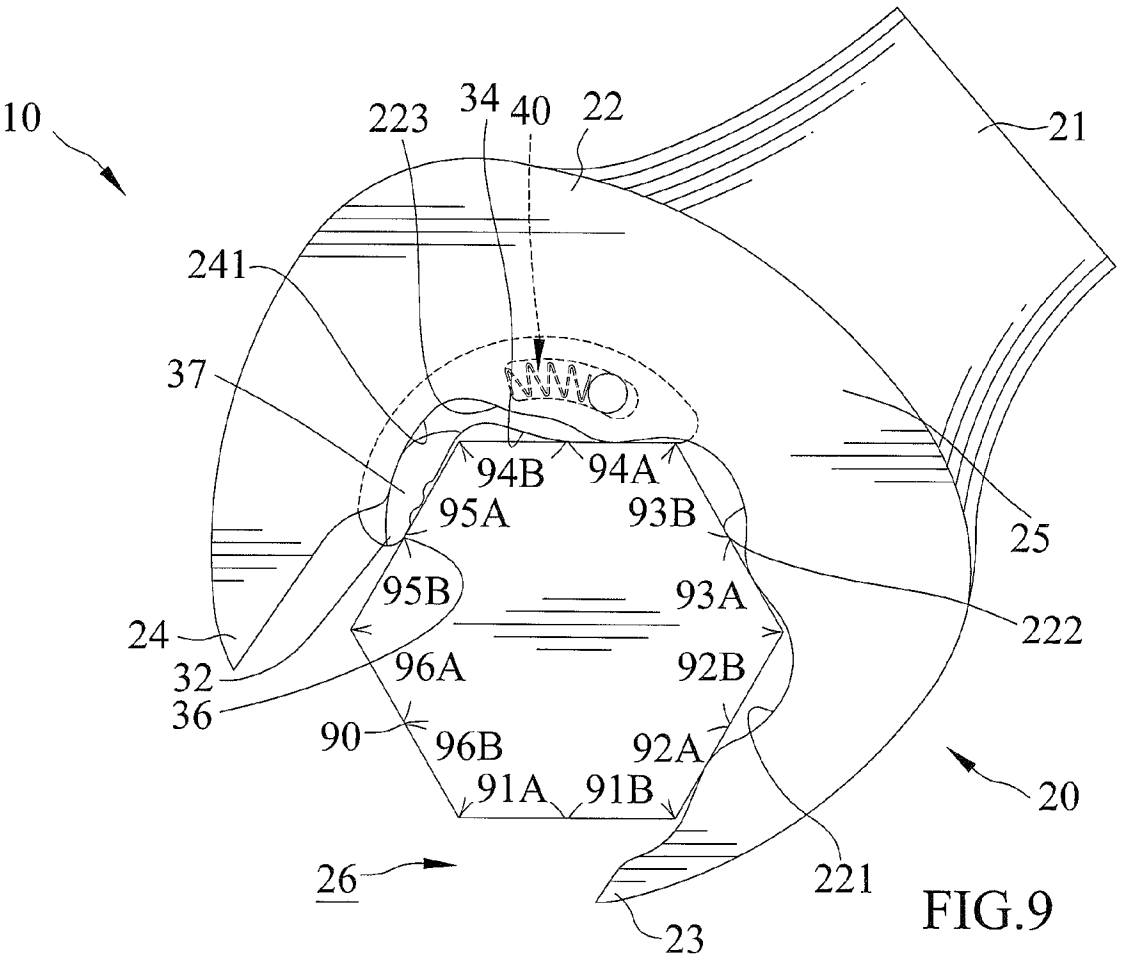
FIG. 9 shows a cross sectional view illustrating further rotation of the open end wrench of FIG. 8 in the non-driving direction to the next driving position.

When rotation of open end wrench 10 in the reverse direction is finished, slide 30 can smoothly and rapidly moved to the extended position, because the two ends of elastic device 40 respectively presses against guide 28 and pressing end 352 of guiding slot 35. The contact area between outer surface 372 of each wing 37 and first face 241 is gradually decreased while slide 30 is moving to the extended position under the bias of elastic device 40 for next driving operation, as shown in FIG. 9.

After workpiece 90 (such as the hexagonal head of a bolt) is screwed to a flat surface (FIG. 4), open end wrench 10 can be in contact with an overall height h2 of workpiece 90 by first wrenching face 32 and top and bottom extension faces 36, providing high-torque operation by increasing the contact area between workpiece 90 and slide 32 through provision of wings 37 while avoiding slide 32 from getting stuck. First wrenching face 32 of slide 30 contacts a portion h1 of height h2 of workpiece 90.

With reference to FIG. 5, when a user intends to rotate workpiece 90 in the driving direction towards first jaw 23 (the clockwise direction in FIG. 5), workpiece 90 is firstly entered wrenching space 26 to a driving position with force-applying face 231 of first jaw 23 of jaw portion 22 abutting first force-receiving face in the first rotating direction 91A of workpiece 90 and with first wrenching face 32 and top and bottom extension faces 36 of slide 30 abutting fourth force-receiving face in the first rotating direction 94A of workpiece 90.

Since fourth force-receiving face in the first rotating direction 94A of workpiece 90 is parallel to first force-receiving face in the first rotating direction 91A, to make first wrenching face 32 and top and bottom extension faces 36 of slide 30 be in surface contact with fourth force-receiving face in the first rotating direction 94A, elastic element 41 in slide 30 is compressed and deformed to move slide 30 along the arcuate path such that first wrenching face 32 and top and bottom extension faces 36 of slide 30 can automatically abut fourth force-receiving face in the first rotating direction 94A while first wrenching face 32 and top and bottom extension faces 36 of slide 30 are substantially parallel to force-applying face 231 of first jaw 23.

In this case, the user can drive handle 21 in the clockwise direction to rotate jaw portion 22 about the center of workpiece 90. The force applied by the user is transmitted through force-applying face 231 of first jaw 23 to first force-receiving face in the first rotating direction 91A of workpiece 90. At the same time, the force applied by the user is transmitted through first wrenching face 32 and top and bottom extension faces 36 of slide 30 to fourth force-receiving face in the first rotating direction 94A of workpiece 90. Thus, workpiece 90 rotates together with jaw portion 22.

Since a portion of outer face 372 of each wing 37 is in contact with second jaw 24 when slide 30 is in the extended position, the force imparted from workpiece 90 to wings 37 can be transmitted to second jaw 24, increasing the torque capacity of open end wrench 90 and providing high-torque driving effect while allowing slide 30 to stably abut against fourth force-receiving face in the first rotating direction 94A of workpiece 90.

Since first jaw 23 and jaw portion 22 are integrally formed as a single and inseparable component of the same material, force-applying face 231 of first jaw 23 can effectively withstand the reactive force from first force-receiving face in the first rotating direction 91A of workpiece 90. Furthermore, since second jaw 24 and jaw portion 22 are integrally formed as a single and inseparable component of the same material and since sliding face 31 of slide 30 and sliding wall 271 of sliding groove 27 are free of holes, grooves, recesses, etc and have the same curvature and are in surface contact with each other, sliding face 31 of slide 30 can contact with sliding wall 271 by a large area, avoiding wobbling of slide 30 in sliding groove 27 while driving workpiece 90. Thus, open end wrench 10 according to the present invention can withstand high-torque operation.

In this embodiment, second wrenching face 33 of slide 30 abuts third force-receiving face in the first rotating direction 93A of workpiece 90. Since second jaw 24 and jaw portion 22 are integrally formed as a single and inseparable component of the same material and since sliding face 31 of slide 30 and sliding wall 271 of sliding groove 27 are free of holes, grooves, recesses, etc and have the same curvature and are in surface contact with each other, sliding face 31 of slide 30 can contact with sliding wall 271 by a large area, avoiding wobbling of slide 30 in sliding groove 27 while driving workpiece 90. Thus, open end wrench 10 according to the present invention can withstand high-torque operation.

FIGS. 6-8 show rotation of open end wrench 10 according to the present invention in the reverse, non-driving direction towards second jaw 24 without driving workpiece 90. Namely, open end wrench 10 is moved in the reverse direction back to a position ready for driving workpiece 90 without the need of disengaging workpiece 90 from wrenching space 26 of jaw portion 22 and subsequent reengaging workpiece 90 in wrenching space 26, allowing fast driving of workpiece 90.

When the user moves handle 21 in the counterclockwise direction, jaw portion 22 and handle 21 rotate freely relative to workpiece 90 such that first and second evasive portions 221 and 222 of jaw portion 22 and evasive portion 34 of slide 30 respectively approach first, second, and third force-receiving faces in the second rotating direction 91B, 92B, and 93B of workpiece 90. Namely, first, second, and third force-receiving faces in the second rotating direction 91B, 92B, and 93B of workpiece 90 enter first and second evasive portions 221 and 222 and evasive portion 34.

Further rotation of jaw portion 22 in the counterclockwise direction causes evasive portion 34 of slide 30 to come into contact with third force-receiving face in the second rotating direction 93B of workpiece 90. In this case, elastic element 41 is compressed and moves slide 30 in sliding groove 27 along the arcuate path. Since not all of outer face 372 of each wing 37 is in surface contact with first face 241, the contact area between outer face 372 of each wing 37 and first face 241 is gradually increased when open end wrench 10 moves in the reverse direction and causes movement of slide 30 to the retracted position, avoiding damage to elastic device 40 while open end wrench 10 moves rapidly in the reverse direction.

When slide 30 is pressed and moved along the arcuate path relative to jaw portion 22, jaw portion 22 can continue its rotation in the counterclockwise direction. Next, force-applying face 231 of first jaw 23 moves across first force-receiving face in the second rotating direction 91B of workpiece 90 and approaches second force-receiving face in the first rotating direction 92A of workpiece 90. At the same time, first wrenching face 32 of slide 30 moves across fourth force-receiving face in the second rotating direction 94B of workpiece 90 and approaches fifth force-receiving face in the first rotating direction 95A of workpiece 90. In this embodiment, second wrenching face 33 of slide 30 also moves across third force-receiving face in the second rotating direction 93B of workpiece 90 and approaches fourth force-receiving face in the first rotating direction 94A of workpiece 90.

With reference to FIG. 9, when rotation of open end wrench 10 in the reverse direction is finished, slide 30 can be smoothly and rapidly moved to the extended position, because the two ends of elastic device 40 respectively presses against guide 28 and pressing end 352 of guiding slot 35. When force-applying face 231 of first jaw 23 abuts second force-receiving face in the first rotating direction 92A of workpiece 90, elastic element 41 returns slide 30 to the extended position and makes first wrenching face 32 of slide 30 abut fifth force-receiving face in the first rotating direction 95A of workpiece 90. Furthermore, first wrenching face 32 of slide 30 automatically comes in surface contact with fifth force-receiving face in the first rotating direction 95A of workpiece 90 such that first wrenching face 32 of slide 30 is substantially parallel to force-applying face 231 of first jaw 23, reliably positioning jaw portion 22 in the new driving position ready for driving workpiece 90 in the clockwise direction without the need of disengaging workpiece 90 from wrenching space 26 of jaw portion 22 and subsequent reengaging workpiece 90 in wrenching space 26, allowing fast driving of workpiece 90. The contact area between outer surface 372 of each wing 37 and first face 241 is gradually decreased while slide 30 is moving to the extended position under the bias of elastic device 40 for next driving operation. Thus, elastic device 40 rapidly moves slide 30 from the retracted position to the extended position.

Thus, open end wrench 10 is moved to the next driving position and is in a state similar to that shown in FIG. 5. The user can again rotate handle 21 in the clockwise direction to make jaw portion 22 rotate about the axis of workpiece 90 and, thus, drive workpiece 90 in the clockwise direction.

Figure 3:
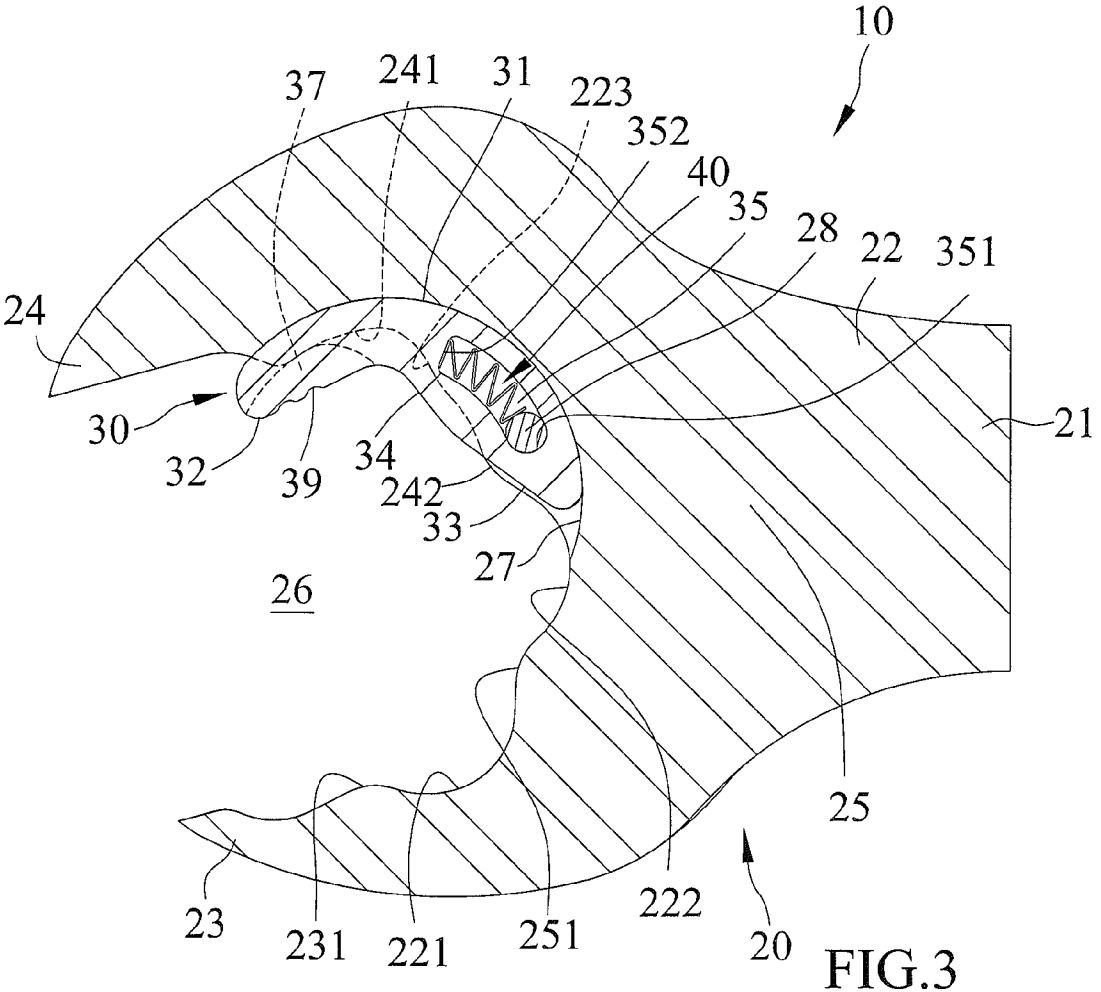
FIG. 3 shows a partial, cross sectional view of the open end wrench of FIG. 1.
Figure 4:
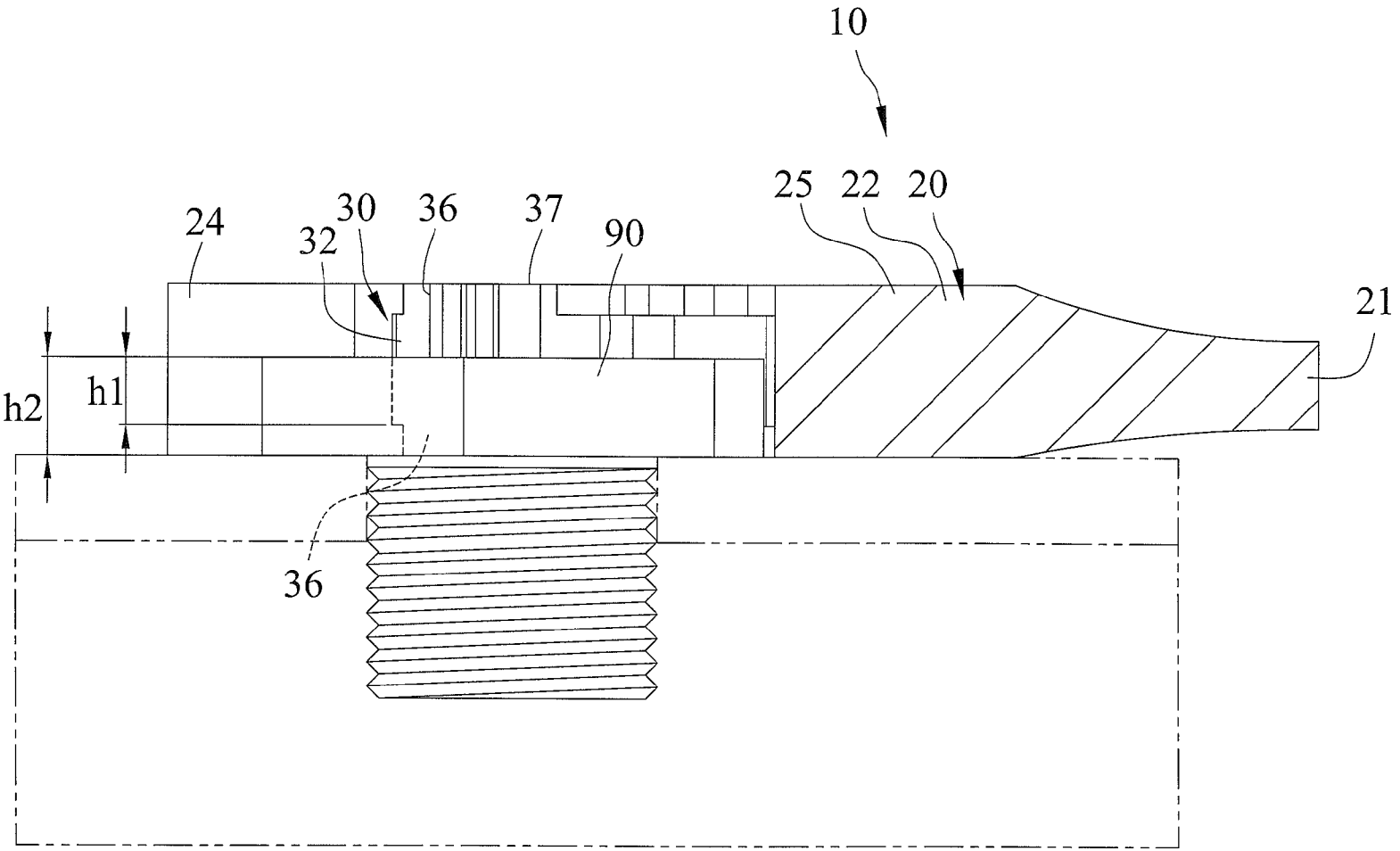
FIG. 4 shows a cross sectional view illustrating use of the open end wrench of FIG. 1 on a workpiece.

With reference to FIG. 3, when jaw portion 22 has not received workpiece 90 yet, abutting end 351 of guiding slot 35 is in contact with guide 28, and slide 30 is in the extended position. First wrenching face 32 of slide 32 and top and bottom extension faces 36 extend into wrenching space 26. First wrenching face 32 of slide 30 is not parallel to force-applying face 231 of first jaw 23.

With reference to FIG. 5, when jaw portion 22 receives workpiece 90 but does not drive workpiece 90, force-applying face 231 of first jaw 23 abuts first force-receiving face in the first rotating direction 91A of workpiece 90, and the front end of slide 30 abuts fourth force-receiving face in the first rotating direction 94A of workpiece 90. At the same time, a gap 38 exists between abutting end 351 of guiding slot 35 and guide 28. Gap 38 is larger than the tolerance of workpiece 90.

When workpiece 90 is rotated by jaw portion 22 and causes deformation of jaw portion 22, body 20 slightly rotates relative to workpiece 20. Gap 38 prevents slide 30 from rotating together with body 20. Thus, the front end of slide 30 can still abut fourth force-receiving face in the first rotating direction 94A of workpiece 90 while jaw portion 22 expands elastically.

With reference to FIG. 5, when jaw portion 22 receives the workpiece 90 but does not drive workpiece 90, a buffering angle θ is formed between first wrenching face 32 of slide 30 and fourth force-receiving face in the first rotating direction 94A of workpiece 90. Buffering angle θ allows body 20 and slide 30 to gradually rotate relative to workpiece 90 when jaw portion 22 expands elastically, such that first wrenching face 32 of slide 30 abuts fourth force-receiving face in the first rotating direction 94A of workpiece 90, providing surface contact between first wrenching face 32 of slide 30 and fourth force-receiving face in the first rotating direction 94A of the workpiece 90. In this embodiment, the buffering angle θ is larger than 2°. Namely, the angle between first and second wrenching faces 32 and 33 of slide 30 is smaller than 118°.

First wrenching face 32 of slide 30 can include at least one groove 39 to increase the friction (i.e., the engagement force) between first wrenching face 32 of slide 30 and fourth force-receiving face in the first rotating direction 94A of workpiece 90.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An open wrench capable of fast driving a workpiece, with the workpiece including an outer periphery having first, second, third, fourth, fifth, and sixth sides respectively having first, second, third, fourth, fifth, and sixth faces in a first rotating direction and respectively having first, second, third, fourth, fifth, and sixth force-receiving faces in a second rotating direction, with the open end wrench comprising, in combination:

a body including a handle and a jaw portion formed on an end of the handle, with spaced first and second jaws formed on an end of the jaw portion opposite to the handle, with the first and second jaws and the jaw portion integrally formed as a single and inseparable component of a same material, with the jaw portion further including a throat intermediate the first and second jaws, with the first jaw including a front end and a rear end, with the rear end of the first jaw connected to the throat, with the second jaw including a front end and a rear end, with the rear end of the second jaw connected to the throat, with the throat and the first and second jaws together defining a wrenching space, with the wrenching space adapted to receive the workpiece, with the first jaw including a force-applying face facing the wrenching space, with the jaw portion further including an arcuate sliding groove facing the wrenching space, with the sliding groove including spaced, first and second support walls and an arcuate sliding wall extending between the first and second support walls, with a guide fixed in the sliding groove, with the guide including two ends fixed in the first and second support walls;

a slide slideably received in the sliding groove, with the slide including a first side having an arcuate sliding face slideable along the sliding wall of the sliding groove, with the slide capable of driving the workpiece or sliding along the outer periphery of the workpiece, with the slide movable between an extended position and a retracted position, with the slide further including a second side opposite to the first side of the slide, with the second side of the slide located outside of the sliding groove and including a first wrenching face located on a front end of the slide, with the slide further including a top face and a bottom face, with the top face slideably abutting the first support wall, with the bottom face slideably abutting the second support wall, with the top and bottom faces symmetrically supported by the first and second support walls, with the slide further including an arcuate guiding slot extending from the top face through the bottom face, with the guide received in the guiding slot, preventing the slide from disengaging from the sliding groove, with the guiding slot including an abutting end and a pressing end, with the front end of the slide including two wings respectively extending away from the top and bottom faces, with each of the two wings including inner and outer faces, with the inner faces of the two wings adapted to drive the workpiece; and an elastic element mounted in the guiding slot and having two ends respectively abutting the guide and the pressing end of the guiding slot, with the elastic element urging the abutting end of the guiding slot to contact with the guide, biasing the slide to the extended position, wherein when the open end wrench drives the workpiece to rotate in a first direction, the slide is in the extended position, the outer face of each of the two wings is partially in contact with the second jaw, force imparted from the workpiece to the two wings is transmitted to the second jaw, the slide stably abuts the workpiece.

2. The open end wrench as claimed in claim 1, wherein:

when the open end wrench rotates in a second direction reverse to the first direction, the slide moves towards the retracted position, a contact area between the outer face of each of the two wings is gradually increased, when the open end wrench reaches a next driving position for driving the workpiece to rotate in the first direction, the elastic element moves the slide to the extended position, the contact area between the outer face of each of the two wings is gradually decreased.

3. The open end wrench as claimed in claim 2, with the first wrenching face including a top extension face extending away from the top face and a bottom extension face extending away from the bottom face, with the top and bottom extension faces coplanar to the first wrenching face and located on the inner faces of the two wings, with only a portion of the outer face of each of the two wings contacting with the first face of the second jaw when the workpiece is driven by the open end wrench in the first direction, with the outer face of each of the two wings having a curvature equal to that of the first face of the second jaw, providing surface contact between the portion of the outer face of each of the two wings and the first face of the second jaw.

4. The open end wrench as claimed in claim 2, with the sliding wall of the sliding groove free of holes, grooves, and recesses and having a concave, arcuate face, with the sliding face of the slide free of holes, grooves, and recesses and having a convex, arcuate face, and with the guiding slot free of holes, grooves, and recesses.

5. The open end wrench as claimed in claim 1, with the force-applying face facing the front end of the second jaw, with the sliding groove formed in the second jaw and the throat and facing the wrenching space, with the force-applying face adapted to correspond to the first force-receiving face in the first rotating direction of the workpiece, with the first wrenching face and the two wings of the slide adapted to correspond to the fourth force-receiving face in the first rotating direction of the workpiece when the slide is in the extended position.

6. The open end wrench as claimed in claim 1, with the sliding face of the slide having a first curvature, with the sliding wall of the sliding groove having a second curvature equal to the first curvature, with the sliding face of the slide smoothly slideable along the sliding wall of the sliding groove, with the sliding face adapted to transmit reactive force from the workpiece to the sliding wall and to avoid concentration of stress on the slide, increasing torque bearing capacity of the slide when the workpiece is driven by the body to rotate, with the guiding slot having a third curvature equal to the second curvature, allowing relative smooth, arcuate sliding between the guiding groove of the slide and the guide in the sliding groove without operational interference therebetween.

7. The open end wrench as claimed in claim 1, with the slide further including a second wrenching face at an angle of 120° to and located behind the first wrenching face, with the second wrenching face adapted to correspond to the third force-receiving face in the first rotating direction of the workpiece, with the slide further including an evasive portion between the first and second wrenching faces, with the evasive portion of the slide adapted to allow entrance of the third force-receiving face in the second rotating direction of the workpiece.

8. The open end wrench as claimed in claim 7, with the throat including a push face facing the wrenching space, with the push face at an angle of 120° to the force-applying face of the first jaw, with the push face of the throat adapted to correspond to the second force-receiving face in the first rotating direction of the workpiece.

9. The open end wrench as claimed in claim 8, with the second jaw including first and second faces, with the first face of the second jaw facing the wrenching space and the rear end of the first jaw, with the second face of the second jaw facing the wrenching space and the front end of the first jaw, with the first face of the second jaw at an angle of 120° to the second face of the second jaw, with the first and second faces of the second jaw adapted to correspond respectively to the fourth and third force-receiving faces in the first rotating direction of the workpiece, with the first face of the second jaw parallel to the force-applying face of the first jaw, with a first evasive portion formed between the force-applying face of the first jaw and the push face of the throat, with the first evasive portion adapted to allow entrance of the first force-receiving face in the second rotating direction of the workpiece, with a second evasive portion formed between the push face of the throat and the second face of the second jaw, with the second evasive portion adapted to allow entrance of the second force-receiving face in the second rotating direction of the workpiece, with the jaw portion further including a third evasive portion between first and second faces of the second jaw, with third evasive portion adapted to allow entrance of the third force-receiving face in the second rotating direction of workpiece.

10. The open end wrench as claimed in claim 1, with the first and second support walls of the sliding groove parallel to each other and having a spacing therebetween, with the top and bottom faces of the slide parallel to each other and having a height in a height direction of the slide equal to the spacing, with the guiding slot of the slide having a height in the height direction of the slide equal to the height of the slide, with the guiding slot having a width in a width direction perpendicular to the height direction of the guiding slot, with the width of the guiding slot equal to a diameter of the guide, with the height of the guiding slot larger than 1.5 times the width of the guiding slot, with the elastic element having a height in the height direction of the slide not larger than the height of the guiding slot, with the height of the elastic element larger than the width of the guiding slot and larger than 0.5 times the height of the guiding slot.

11. The open end wrench as claimed in claim 1, wherein:

when the jaw portion does not receive the workpiece, the abutting end of the guiding slot is in contact with the guide, the slide is in the extended position, the first wrenching face of the slide and the top and bottom extension faces extend into the wrenching space, the first wrenching face of the slide is not parallel to the force-applying face of the first jaw, when the jaw portion receives the workpiece but does not drive workpiece, the force-applying face of the first jaw abuts the first force-receiving face in the first rotating direction of the workpiece, the front end of slide abuts the fourth force-receiving face in the first rotating direction of the workpiece, a gap exists between the abutting end of the guiding slot and the guide, the gap is larger than a tolerance of the workpiece, when the workpiece is rotated by the jaw portion and causes deformation of the jaw portion, the body slightly rotates relative to the workpiece, the gap prevents the slide from rotating together with the body, the front end of the slide remains abutting the fourth force-receiving face in the first rotating direction of the workpiece while the jaw portion expands elastically.

12. The open end wrench as claimed in claim 11, wherein:

when the jaw portion receives the workpiece but does not drive the workpiece, a buffering angle is formed between the first wrenching face of slide and the fourth force-receiving face in the first rotating direction of the workpiece, the buffering angle allows the body and the slide to gradually rotate relative to the workpiece when the jaw portion expands elastically, the first wrenching face of the slide abuts the fourth force-receiving face in the first rotating direction of the workpiece, providing surface contact between the first wrenching face of the slide and the fourth force-receiving face in the first rotating direction of the workpiece, the buffering angle is larger than 2°.

13. The open end wrench as claimed in claim 12, with the first wrenching face of the slide including at least one groove, with said at least one groove adapted to increase friction between the first wrenching facer and the fourth force-receiving face in the first rotating direction of the workpiece.

* * * * *